US012072094B2

(12) United States Patent
Al Ahdal et al.

(10) Patent No.: US 12,072,094 B2
(45) Date of Patent: Aug. 27, 2024

(54) INTELLIGENT PREDICTION OF BOILER BLOWDOWN

(71) Applicant: SAUDI ARABIAN OIL COMPANY, Dhahran (SA)

(72) Inventors: Ahmad Mohammad Al Ahdal, Hafouf (SA); Hadi Abdullrahman Alshehri, Hafouf (SA); Shadi Mohammed Al-Hazmi, Hafouf (SA); Abdulelah Saeed Al Qahtani, Mubaraz (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 393 days.

(21) Appl. No.: 17/709,135

(22) Filed: Mar. 30, 2022

(65) Prior Publication Data

US 2023/0313984 A1 Oct. 5, 2023

(51) Int. Cl.
*F22B 37/56* (2006.01)
*F22B 37/42* (2006.01)
*F22B 37/62* (2006.01)

(52) U.S. Cl.
CPC ..... *F22B 37/565* (2013.01); *F22B 37/421* (2013.01); *F22B 37/62* (2013.01)

(58) Field of Classification Search
CPC ..... F22B 37/62; F22B 37/56; F22B 37/54; F22B 33/00; F22B 35/008
See application file for complete search history.

(56) References Cited

U.S. PATENT DOCUMENTS 4,047,005 A * 9/1977 Heiser ..... F01K 23/108 290/40 R
4,403,293 A * 9/1983 Bradt ..... F22B 35/008 236/14
4,465,026 A * 8/1984 Carberry ..... F22B 37/565 122/382
4,639,718 A * 1/1987 Gasper ..... C02F 1/685 210/85

(Continued)

FOREIGN PATENT DOCUMENTS

CA 2542764 A1 3/2005
CN 102080820 A 6/2011

(Continued)

OTHER PUBLICATIONS

Moleda et al.; "Predictive Maintenance of Boiler Feed Water Pumps Using SCADA Data", Sensors; vol. 20; No. 571; Jan. 20, 2020; pp. 1-19 (19 pages).

*Primary Examiner* — Gregory A Wilson
(74) *Attorney, Agent, or Firm* — Osha Bergman Watanabe & Burton LLP

(57) ABSTRACT

A method for predicting a blowdown rate of one or more boilers includes generating output data with a first model that specifies an empirical relationship between multiple input temperatures, multiple plant gas feed rates, and multiple outputs of the boilers. The method further includes collecting an ambient operating temperature and a current steam demand of the boilers and comparing the ambient operating temperature and the current steam demand to the output data to determine a current required blowdown rate. Once determined, the blowdown rate of the boilers is adjusted according to the current required blowdown rate.

20 Claims, 7 Drawing Sheets

(56) References Cited

U.S. PATENT DOCUMENTS

| | | | | | |
|---|---|---|---|---|---|
| 5,041,386 | A * | 8/1991 | Pierce | F22D 11/006 | 436/52 |
| 5,663,489 | A * | 9/1997 | Thungstrom | G01M 3/228 | 422/62 |
| 5,696,696 | A | 12/1997 | Gunther et al. | | |
| 5,756,880 | A | 5/1998 | Chen et al. | | |
| 6,076,048 | A | 6/2000 | Gunther et al. | | |
| 6,244,098 | B1 * | 6/2001 | Chen | F22B 37/421 | 73/40 |
| 2016/0103089 | A1 * | 4/2016 | Boyette | G01N 27/08 | 356/72 |

FOREIGN PATENT DOCUMENTS

| | | | | |
|---|---|---|---|---|
| CN | 110363289 | A | 10/2019 | |
| CS | 263785 | B1 * | 4/1989 | |
| EP | 2924572 | A2 * | 9/2015 | F22B 35/18 |
| GB | 2572547 | A | 10/2019 | |
| WO | 2007038533 | A2 | 4/2007 | |

* cited by examiner

| Plant Gas Feed Rate | Total Steam Demand | Cogen Production | Available Steam | Boilers Production | Excess Steam | Production by Boiler | Steam Production | Conductivity | Open | Date | Temp |
|---|---|---|---|---|---|---|---|---|---|---|---|
| 1700 | 1400 | 1830 | -430 | 500 | 930 | 250 | 180 | 150 | half turn | 11/78/2019 7:00 | 29 |
| 1850 | 1500 | 1830 | -330 | 500 | 830 | 250 | 200 | 170 | half turn | 11/78/2019 19:00 | 18 |
| 1900 | 1600 | 1830 | -230 | 500 | 730 | 250 | 220 | 190 | half turn | 11/79/2019 7:00 | 26 |
| 1800 | 1700 | 1830 | -130 | 500 | 630 | 250 | 240 | 210 | half turn | 11/79/2019 19:00 | 18 |
| 1750 | 1800 | 1830 | -30 | 500 | 530 | 250 | 260 | 230 | half turn | 11/20/2019 7:00 | 22 |
| 1850 | 1900 | 1830 | 70 | 500 | 430 | 250 | 280 | 250 | half turn | 11/20/2019 19:00 | 13 |
| 1900 | 2000 | 1830 | 170 | 500 | 330 | 250 | 300 | 270 | half turn | 11/21/2019 7:00 | 19 |
| 1700 | 2100 | 1830 | 270 | 500 | 230 | 250 | 320 | 290 | half turn | 11/21/2019 19:00 | 9 |
| 1850 | 2200 | 1830 | 370 | 500 | 130 | 250 | 340 | 310 | half turn | 11/22/2019 7:00 | 20 |
| 1800 | 2300 | 1830 | 470 | 500 | 30 | 250 | 360 | 330 | half turn | 11/22/2019 19:00 | 10 |
| 1800 | 2400 | 1830 | 570 | 570 | 0 | 285 | 380 | 350 | half turn | 11/23/2019 7:00 | 22 |
| | | | | | | | 400 | 370 | half turn | 11/23/2019 19:00 | 12 |
| | | | | | | | 420 | 390 | half turn | 11/24/2019 7:00 | 23 |
| | | | | | | | 440 | 300 | one turn | 11/24/2019 19:00 | 14 |
| | | | | | | | 460 | 320 | one turn | 11/25/2019 7:00 | 23 |
| | | | | | | | 480 | 340 | one turn | 11/25/2019 19:00 | 12 |
| | | | | | | | 500 | 360 | one turn | 11/26/2019 7:00 | 23 |
| | | | | | | | 520 | 380 | one turn | 11/26/2019 19:00 | 12 |
| | | | | | | | 540 | 400 | one turn | 11/27/2019 7:00 | 24 |
| | | | | | | | 550 | 420 | one turn | 11/27/2019 19:00 | 13 |

*FIG. 3*

49

67

| | |
|---|---|
| Total Plant Rate | 1724 |
| Ambient Temperature | 43 |
| Steam Demand Theorectical | 1,912.04 |

59

| | |
|---|---|
| Boiler1 Predicted Steam Production | 250 |
| Boiler2 Predicted Steam Production | 250 |

63

| | |
|---|---|
| Selected Steam Demand Theoretical | 1,912.04 |
| Steam Demand Theoretical 0-10 c0 | 2,144.43 |
| Steam Demand Theoretical 10-15 c0 | 2,092.9 |
| Steam Demand Theoretical 15-20 c0 | 2,093.05 |
| Steam Demand Theoretical 20-25 c0 | 2,091.58 |
| Steam Demand Theoretical 25-30 c0 | 2,071.5 |
| Steam Demand Theoretical 30-35 c0 | 2,017.77 |
| Steam Demand Theoretical 35-40 c0 | 1,974.68 |
| Steam Demand Theoretical 35-45 c0 | 1,912.04 |

61

| | |
|---|---|
| Cogen 1 Predicted Steam Production | 576.442 |
| Cogen 2 Predicted Steam Production | 600.327 |
| Cogen 3 Predicted Steam Production | 668.175 |
| Total Cogen Predicted Steam Production | 1,844.94 |

69

| | |
|---|---|
| Cogen 1 Steam Production | 585 |
| Cogen 2 Steam Production | 587 |
| Cogen 3 Steam Production | 666 |
| Total Cogen Steam Production | 1,837 |

65

Proposed Boiler Blowdown Valve Open (Now)

| | |
|---|---|
| 1 Quarter Turn | Half Turn |
| 3 Quarters Turn | One Turn |

Proposed Boiler Blowdown Valve Open (After 6 Hours)

| | |
|---|---|
| 1 Quarter Turn | Half Turn |
| 3 Quarters Turn | One Turn |

Proposed Number of Online Boilers

| | |
|---|---|
| Zero Boiler | 1 Boiler |
| 2 Boilers | 3 Boilers |

55

| | |
|---|---|
| Boiler1 Steam Production | 0 |
| Boiler2 Steam Production | 0 |
| Boiler3 Steam Production | 0 |
| Boiler4 Steam Production | 283 |
| Boiler5 Steam Production | 273 |
| Total Boilers Steam Production | 558 |

57

| | |
|---|---|
| Total Steam Production | 2,396 |
| Excess Steam | 340 |
| Steam Demand Actual | 2,056 |

FIG. 5

INTELLIGENT PREDICTION OF BOILER BLOWDOWN

BACKGROUND

A combined cycle gas plant contains a series of boilers that combust input gas, or plant feed gas, to create heat. This heat is used to boil feedwater that drives a turbine, creating electricity. The presence of solids within the feedwater can accumulate if the feedwater is not periodically drained and replaced. Furthermore, the accumulation of solids within the feedwater affects the conductivity thereof, as the solids conduct electricity more effectively than the feedwater. The process of draining the feedwater to remove the solids or other impurities is called blowdown, and is completed by operating a blowdown valve on the boilers to drain the feedwater.

The specific amount of feedwater that is drained during blowdown is calculated in a laboratory, and these calculations must happen on a frequent basis to prevent unwanted scaling within the boilers. Furthermore, the calculations may not properly account for the result of inefficiencies or inaccuracies in the gas plant operation, which may be the result of previously unremoved solids, changes in ambient operating conditions, or boiler damage. Finally, transcription errors may occur in the process of calculating blowdown rates, which can cause damage to the plant if too much feedwater is drained during blowdown.

SUMMARY

A method for predicting a blowdown rate of one or more boilers includes generating output data with a first model that specifies an empirical relationship between multiple input temperatures, multiple plant gas feed rates, and multiple outputs of the boilers. The method further includes collecting an ambient operating temperature and a current steam demand of the boilers and comparing the ambient operating temperature and the current steam demand to the output data to determine a current required blowdown rate. Once determined, the blowdown rate of the boilers is adjusted according to the current required blowdown rate.

A system for predicting a blowdown rate of one or more boilers includes a plurality of sensors, a first model, and a second model. The sensors measure and output an ambient operating temperature and a current steam demand of the one or more boilers. The first model generates output data specifying an empirical relationship between multiple input temperatures, multiple plant gas feed rates, and multiple outputs of the boilers. A second model compares the ambient operating temperature and the current steam demand to the output data to determine a current required blowdown rate, and the blowdown rate of the one or more boilers is adjusted according to the current required blowdown rate.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

FIG. 3 shows a table in accordance with one or more embodiments of the present disclosure.

FIG. 5 shows an operator dashboard in accordance with one or more embodiments of the present disclosure.

DETAILED DESCRIPTION

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the invention are directed towards a series of models that monitor and predict steam production, blowdown rates, and other operating conditions of a series of boilers. The models utilize a number of sensors to collect the ambient operating temperature, current plant gas feed, and current steam production rate of the series of boilers and subsequently generate a predicted steam production rate and a current conductivity concentration of the current steam demand. After generating the predicted and current values, the models are configured to self-update with the operating conditions in order to develop a larger database of relevant scenarios. The output of the tool is an advisory dashboard that directs an operator to 1) operate a valve that controls the blowdown rate and 2) activate a specific number of boilers to meet the anticipated steam demand.

The anticipated steam demand is derived from the cogeneration, or "cogen" process within the gas plant and its associated energy generation. In particular, cogeneration refers to the process of generating energy using both electricity and heat. Electricity may be generated by using heated steam within the boiler to actuate a turbine, after which the heat from the heated steam is redistributed to heat the plant, as is commonly known in the art. Thus, the current steam demand is a reflection of the cogeneration needed to ensure continued operation of the gas plant.

Figure 1:
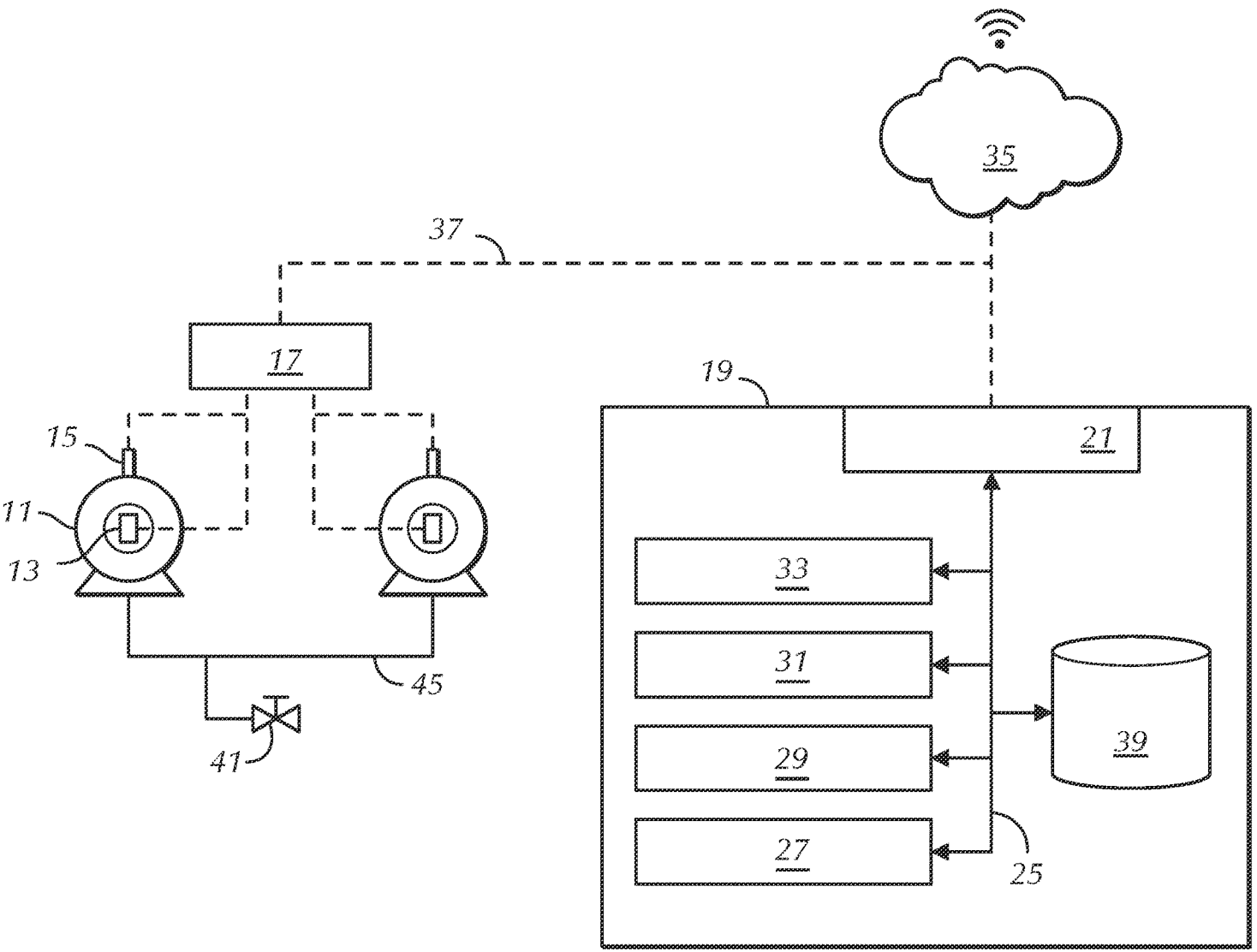
FIG. 1 shows a system in accordance with one or more embodiments of the invention.

FIG. 1 depicts a physical system overview in accordance with one or more embodiments of the invention. As shown in FIG. 1, a combined cycle gas plant contains a series of boilers 11 that are connected to a central hub 17, which may be embodied as a data bus. The central hub 17 is connected to a computer 19 via a network 35, which is, in turn, connected to the internet and/or to the gas plant intranet. The network 35 receives data concerning forecast conditions of the gas plant, which include the forecast steam demand and ambient operating temperature for a period of at least 6 hours. While not shown, the physical system may further include other sensors or devices that facilitate the gas plant's operation such as overflow tanks, barometers, and conductivity and resistivity meters without deviating from the scope of the invention.

Embodiments as described herein may be implemented on a computer 19 as depicted in FIG. 1. That is, elements of the computer 19 are intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Furthermore, the computer 19 may include an input device, such as a keypad, keyboard, touch screen, or other device that accepts user information, and an output device that conveys information associated with the operation of the computer 19, including digital data, visual, or audio information (or a combination of information), or a graphical user interface (GUI). Although only one processor, memory, network, data connection, service layer, application programming interface (API), and interface system bus, and computer are depicted in FIG. 1, the number of each of these components may be varied without deviating from the scope of this disclosure.

The computer 19 may serve in a role as a client, network component, a server, a database, or any other component (or a combination of roles) of a computer system for performing the subject matter described in the instant disclosure. As illustrated, the computer 19 is communicably coupled with a network 35 and boilers 11 via the data connection 37 and the central hub 17. The data connection 37 may be embodied as either a virtual connection such as Wi-Fi or Bluetooth (trademarked), or a physical connection such as ethernet. Similarly, while the network 35 is shown as wirelessly communicating with the internet and intranet, such may be embodied as any of the physical or wireless connections detailed above. In some implementations, one or more components of the computer 19 are configured to operate within these environments, including cloud-computing-based, local, global, or other environment (or a combination of environments).

Each of the components of the computer 19 are interconnected using a system bus 25. In some implementations, any or all components of the computer 19, including both hardware or software, may interface with each other and/or the interface 21 using an API 29, a service layer 27, or a combination thereof. The API 29 includes specifications for routines, data structures, and object classes, and may be computer-language independent or dependent and, thus, refer to a complete interface, a single function, or even a set of APIs. Similarly, the service layer 27 provides software services to the computer 19 or other components that are communicably coupled to the computer 19.

The computer 19 includes at least one computer processor 33, which executes instructions and manipulates data to perform the operations of the computer 19 and any algorithms, methods, functions, processes, flows, and procedures as described in the instant disclosure. The computer 19 also includes a memory 39 that holds data for the computer 19 and/or other components that are connected to the network 35. By way of example, the memory 39 is a database storing data consistent with this disclosure, such as the data table depicted in FIG. 3.

To interact with a user, the computer 19 includes an interface 21, which is embodied as the dashboard interface as described herein and is depicted in FIG. 5. Generally, the interface 21 includes logic encoded in software or hardware (or a combination of software and hardware) and operates to communicate with the network 35 and data connection 37 according to user instructions. Similarly, the application 31 is an algorithmic software engine providing functionality according to particular needs, desires, or implementations of the computer 19, particularly with respect to functionalities described within this disclosure. As described herein, the application 31 may be embodied as a series of models that interpret and manipulate data to produce a requested output.

Continuing with FIG. 1, each of the boilers 11 includes an ambient temperature sensor 13 and a flow rate sensor 15. The flow rate sensor 15 measures the feed rate of plant gas going into the boiler, while the ambient temperature sensor 13 receives the ambient air temperature of the gas plant. Each sensor is connected to the central hub 17, which collects the outputs of all sensors and transmits the outputs to the computer 19 via the data connection 37.

The boilers 11 are gas boilers configured to receive gas from production oil or gas wells (not shown) and combust the gas to generate steam that drives a turbine. This gas, referred to as plant feed gas, is measured via the flow rate sensor 15 to control and determine the total energy output of the boilers 11. As the feed gas is combusted, heat produced from the combustion is used to boil feedwater that drives a turbine of the boiler (not shown). However, impurities, such as oils and fats, may be introduced during steam production in cases where the suspended solids are not boiled with the feedwater. As the level of impurities within the boiler increases, the steam bubbles tend to become more stable and fail to burst as they reach the water surface of the boiler. There comes a point in time (depending on boiler pressure, size, and steam load) where a substantial part of the steam space in the boiler becomes filled with bubbles and foam is carried over into a steam main (not shown).

In order to address the above issues, the boilers 11 are interconnected via a blowdown pipe 45, which outputs to a blowdown valve 41. Throughout an operation cycle of the plant, and after a number of impurities has collected, the blowdown valve 41 is opened to a specific aperture in order to release the suspended solids. The process of opening the blowdown valve 41 to control the level of impurities as discussed herein is referred to as "blowdown". The blowdown valve 41 is typically embodied as a gate valve, but is not limited to such. For example, the blowdown valve 41 may be a globe valve, a butterfly valve, or other valves commonly known in the art. Furthermore, the blowdown valve 41 and blowdown pipe 45 may be formed of cast iron, steel, or equivalent.

Figure 2:
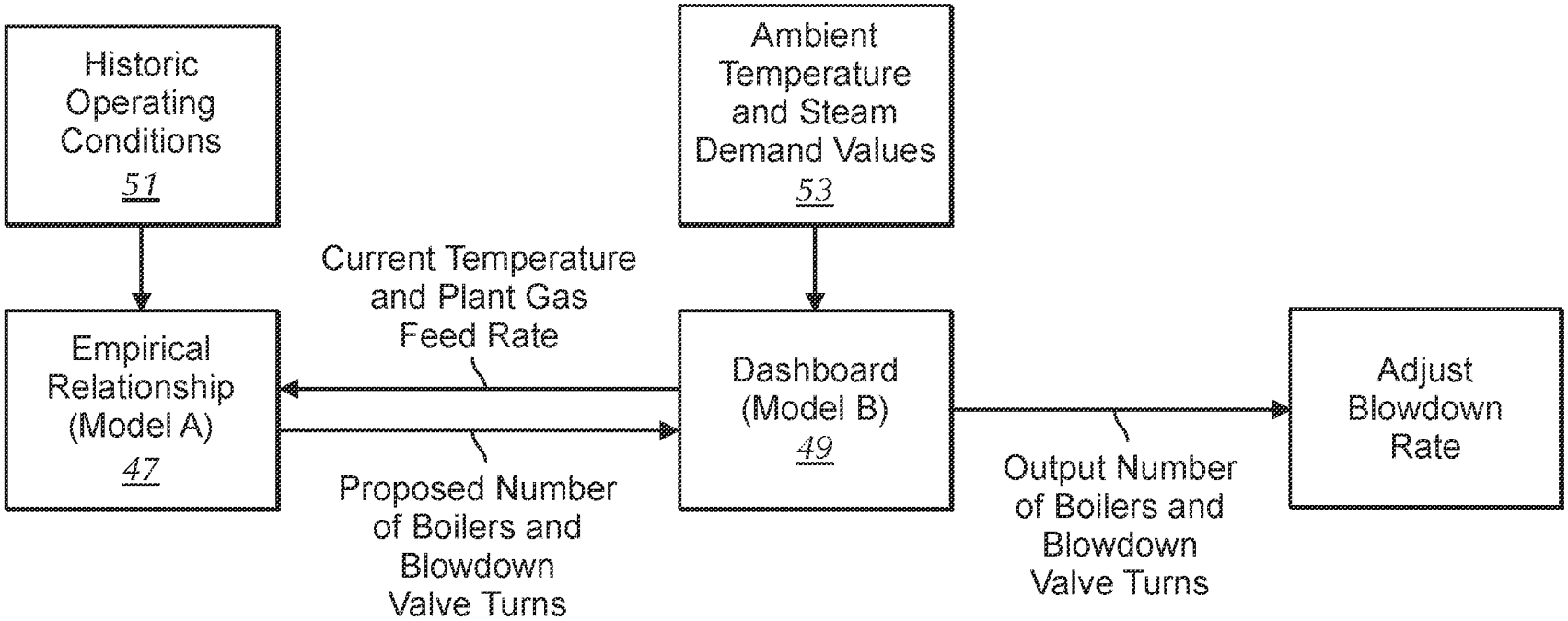
FIG. 2 shows an operational sequence in accordance with one or more embodiments of the present disclosure.

FIG. 2 depicts an operational sequence of controlling the conductivity and steam production levels of the system depicted in FIG. 1. Specifically, FIG. 2 shows an empirical relationship 47, or Model A, that receives historic operating conditions 51, which may be received via the network 35 or are previously stored in the memory 39. The historic operating conditions 51 include an ambient temperature, a plant gas feed rate, a steam demand, a conductivity value correlating the steam demand, and a blowdown rate corresponding to the conductivity value for a plurality of testing times and periods. The historic operating conditions 51 are stored in a data lookup table in the memory 39. The act of storing the data in a lookup table forms the empirical relationship 47 (Model A) between the values contained therein.

Subsequent to developing the empirical relationship, a dashboard 49, Model B, receives the current ambient temperature and steam demand values 53 of the boilers 11 as its input. These values 53 are used by Model B to lookup a blowdown rate and active number of boilers 11 that correspond to the current ambient temperature and the conductivity created by the steam demand. The blowdown rate includes a proposed number of turns, or aperture, of the blowdown valve 41 that reduces the amount of dissolved solids in the feedwater to reduce the conductivity thereof. Once known, the blowdown rate is output via Model B to an operator as a number of active boilers 11 and a proposed number of turns of a blowdown valve according to the blowdown rate. An operator then adjusts the blowdown valve and activates a number of boilers 11 according to the dashboard 49, completing the sequence of controlling the conductivity and steam production levels.

Figure 4:
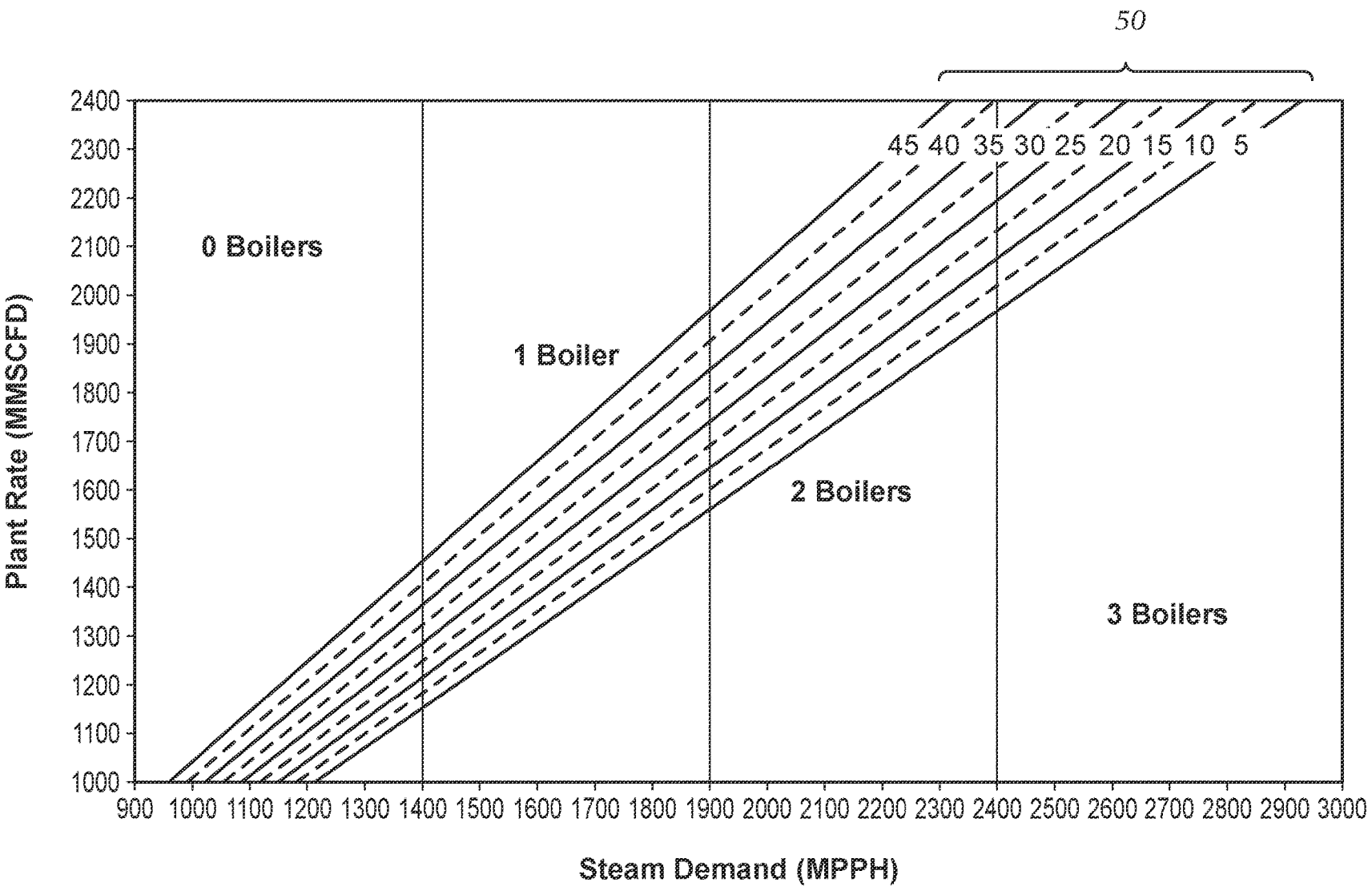
FIG. 4 shows a graph in accordance with one or more embodiments of the present disclosure.

FIGS. 3 and 4 depict overviews of the first model, Model A, which stores the historic operating conditions described above as an empirical collection of data. As shown in FIG. 3, Model A is primarily formed of a lookup table that contains a plurality of inputs and their corresponding empirically-collected operating conditions. Such inputs and outputs are reflected by the "cogen production", "available steam", "boilers production", "excess steam", "production by boiler", "steam production", "open", "date", and "temp" columns of FIG. 3. In particular, the "cogen production" column of FIG. 3 describes the total cogeneration production amount, which reflects the total energy output of the plant as a function of the electricity and heat generated by the steam production in terms of MPPH, or Mass Pounds Per Hour. The "available steam" column is an expression of the difference between the total steam demand (reflected in the "total steam demand" column) and the cogen production (reflected in the "cogen production" column), and reflects the amount of available energy in the plant. The "boilers production" and "production by boilers" columns specify the total energy output the boilers and the individual boiler output, respectively. The "excess steam" column is an expression of the "boilers production" column minus the "available steam" column, and reflects the total amount of extra steam available to the boilers. The "open" column reflects the aperture that a blowdown valve is opened as a result of the input conditions. Finally, the "date" and "temp" columns correspond to values of the calendar date and ambient temperature of the plant corresponding to the operating conditions.

In addition to the above, the data table of Model A stores the change in conductivity for the associated boiler operating conditions. Specifically, because the total steam demand is met by the cogen production, the amount of steam input into the cogeneration process by the boilers 11 is reflected in the "steam production" column. The amount of steam produced for the cogeneration process is used to empirically determine the conductivity change within the boilers 11. Specifically, the amount of impurities created by generating the steam demand is measured by comparing the conductivity of the water before and after generating the steam, and the resultant conductivity value is stored in the "conductivity" column. Once the conductivity amount for a specific steam demand is known, the blowdown rate corresponding to the conductivity amount is also calculated. The blowdown rate is expressed in terms of the number of turns, or specific aperture, of the blowdown valve 41 that compensates for the increased conductivity due to steam generation.

Accordingly, the data stored in Model A and reflected in the table of FIG. 3 and the graph of FIG. 4 stores an empirically determined relationship between the plant gas feed rate, the ambient temperature, and the steam demand, as well as the resulting conductivity and blowdown rate of the boilers 11. Such values are empirically determined in a laboratory for a plurality of potential operating conditions to form a lookup table with the ambient temperature, plant gas feed rate, and steam demand as input variables.

In order to make more accurate predictions, the table of Model A containing historical data is updated at a specified interval with the current operating conditions of the plant. The specified interval may be a period of minutes, hours, or days, with the data shown in FIG. 3 being taken in 12 hour intervals. In general, the accumulated impurities increase the steam demand at a given time, due to the increased amount of waste heat generated in the impurities. As such, because Model A is empirically based, the updated values ensure that Model A can advantageously account for the long term accumulation of impurities within the boilers.

Consistent with the above, Model B is further configured to replace historic values of the data table with their more recent counterparts. For example, if Model B detects that the measured inputs are substantially similar to a set of historic inputs, Model B is configured to replace the data corresponding to the oldest historic inputs with the new data reflecting the current measured inputs, operating conditions, and corresponding blowdown rate. Finally, if no historic data exists for the ambient operating conditions, Model B stores the data as a new dataset to be used in future steam demand determinations, and does not recommend a specific number of active boilers or blowdown rate. It is noted that if Model B replaces historic values with their current counterparts, then Model A is not updated with the current operating conditions to avoid redundancy.

Although only a few rows of Model A are depicted in FIG. 3, Model A contains historical data for thousands of potential operating conditions. The historical data is comprised of a series of laboratory tests to determine a steam demand corresponding to an ambient temperature and plant gas feed rate. As such, the output of Model A is both a table correlating the empirically determined values, as shown in FIG. 3, or a visual aid, shown in FIG. 4, that displays the data in a graphical form. As shown in FIG. 4, the graph depicts a correlation between a proposed number of boilers that are active, a plant feed rate, a steam demand, and an ambient operating temperature at the boilers.

As shown in FIG. 4, the ambient temperature, which is reflected in the ambient temperature indication lines 50, causes an increase in steam demand as the temperature decreases. Thus, in FIG. 4, the ambient temperature (shown in degrees Celsius) and current plant gas feed rate (shown in Million Standard Cubic Feet per Day of gas, or MMSCFD) can be correlated to the steam demand (shown in Million Parts Per Hour, or MPPH), and directly correspond to the number of boilers that must be active to meet a specified steam demand, which is further detailed below. Accordingly, for any input plant feed rate and ambient temperature, the number of proposed active boilers can be determined based upon the historical data indicating previous boiler use and a number of active boilers at similar operating conditions. This data is the utilized by the second model, Model B, which interprets the data contained in Model A and outputs a proposed blowdown rate and active number of boilers.

FIG. 5 depicts one embodiment of Model B, which is formed as a dashboard 49 displayed to an operator on the computer 19. The dashboard 49 contains a number of indicators that display real time and forecast data concerning the boiler operation. In particular, the dashboard 49 contains an ambient condition indicator 67, a cogeneration indicator 69, a current steam production indicator 55, a total steam production indicator 57, a predicted steam production indicator 59, a predicted cogen indicator 61, a predicted steam demand indicator 63, and a predicted blowdown indicator 65. During operation, values reflected in the ambient condition indicator 67 are searched, using a lookup command or algorithm in the computer 19, to find a corresponding theoretical steam demand, which is output in the ambient condition indicator 67. As noted above, if a corresponding theoretical steam demand is not found within Model A, Model B stores the current operating conditions of the plant as a new dataset within Model A.

Initially, an amount of steam and cogeneration energy, reflected in the current steam production indicator 55 and the cogeneration indicator 69, respectively, are used to determine the total current steam production of the gas plant. In particular, the "total cogen production value" in the cogeneration indicator 69 and the "total boilers steam production value" in the current steam production indicator 55, which reflect the respective total steam or cogen created by each boiler 11, are added together to create a total steam production. The actual steam demand that is currently required by the plant is subtracted from the total steam production value in order to determine the excess steam available in the boilers 11, and the actual steam demand, total steam production, and excess steam are output in the total steam production indicator 57. The dashboard 49 then compares the determined total steam production and excess steam values to the data stored in Model A, and determines the number of boilers 11 that are currently required to be active to meet the required steam demand value. Alternatively, the dashboard 49 may be configured to interpolate the number of boilers based upon the ambient temperature and plant gas feed rate.

To determine the number of active boilers, it is assumed that the boilers have at least 1400 Mega Pounds Per Hour ("MPPH") in excess or dispatch steam available; no boilers are required to be active when the steam demand is less than 1400 MPPH. As such, the specified steam demand may be classified into boiler regions in 500 MPPH increments, which is the maximum amount of steam that a single boiler may produce. Thus, a new boiler must be activated according to the following formula:

$$B=\text{ceil}((S-R)/M) \quad (1)$$

Where B is the proposed number of boilers online, determined by subtracting the steam reserve, R, from the steam demand, S, and dividing by the maximum individual boiler output, M, which is rounded up to the nearest whole number. By way of example, for a steam reserve of 1400 MMPH, a steam demand of 2200 MMPH, and a maximum boiler output of 500 MMPH, the number of active boilers is determined to be 2. Thus, the active number of boilers is determined as a function of both the plant feed gas rate and the ambient temperature, via the determined steam demand, the relationship(s) thereof being implicitly defined within the data table shown in FIG. 3.

The number of active boilers is recommended to the operator via the predicted blowdown indicator 65 in a visual format. Specifically, the dashboard 49 contains indicators for zero, one, two, or three active boilers, each number of active boilers being indicated with a different color of highlight. Thus, an operator can quickly and accurately determine the number of active boilers, as the correct number of active boilers is visually represented in a colorful format.

Because the data stored in Model A also contains the conductivity values associated with a given steam demand, the dashboard 49 also determines the conductivity of the boilers 11 developed as a result of producing the required steam amount. Once the conductivity value correlating to the required steam amount is found, the aperture of the blowdown valve 41 that aligns with the given conductivity amount is output to the predicted blowdown indicator 65. As shown in FIG. 5, the aperture is given as a fractional number of turns of a blowdown valve. The recommended number of turns is specified in quarter turn increments, and the dashboard 49 highlights, with separate colors, whether a quarter turn, half turn, three-quarters turn, or one turn of the blowdown valve is necessary. It is noted that one full turn corresponds to a fully open blowdown valve, and, as such, the number of turns recommended by the dashboard 49 may change if a different valve is used.

Once output to the operator, the operator manually adjusts the blowdown valve 41 to the specified aperture by manually turning the blowdown valve. In addition, the operator ensures that the correct number of boilers 11 are active according to the proposed number of boilers, and activates/deactivates boilers 11 as necessary. Accordingly, control of a blowdown rate, which is determined by the aperture of the blowdown valve 41 and created by the number of active boilers, is gained by comparing only the ambient temperature and plant feed gas rate to the empirical relationship exemplified by Model A, and actuating the blowdown valve and boilers accordingly.

However, the operation of the dashboard 49 is not limited to current operating conditions alone. Rather, the dashboard 49 is also configured to determine operating conditions for a future period of time, the results of the determination being output to the operator. To do such, the computer 19 connects to the plant intranet or internet (not shown) to retrieve forecast operating conditions, which include a forecast steam demand and forecast ambient temperature. The dashboard 49 then compares the forecast operating conditions to the table of Model A in order to find a number of active boilers 11 and an aperture of the blowdown valve 41 at conditions corresponding to the forecast operating conditions. The resulting forecast number of active boilers 11 and blowdown valve 41 aperture is output to the operator in the predicted blowdown indicator 65, at which point an operator may actuate the blowdown valve 41 to the forecast required blowdown rate.

Because weather conditions may vary greatly across a period of hours, or may change without warning, the dashboard 49 also predicts the theoretical steam demand for a plurality of potential temperatures for the maximum forecast time, or 6 hours. As noted above, the steam demand of the boilers 11 depends on the ambient operating temperature of the boilers. Accordingly, when the dashboard 49 receives the theoretical steam demand, the dashboard 49 computes multiple shifted steam demands by increasing or decreasing the theoretical steam demand according to the difference between the theoretical ambient temperature and one potential temperature of the plurality of potential temperatures. Each shifted steam demand is output to an operator via the predicted steam demand indicator 63, and the operator may selectively adjust the blowdown rate according to the theoretical steam demand of a different ambient temperature rather than the forecast ambient temperature. Thus, overall, the operator may selectively actuate the blowdown valve 41 to either the current or forecast required aperture, and the determination may be made based upon the current and/or forecast operating conditions of the boilers.

Figure 6:
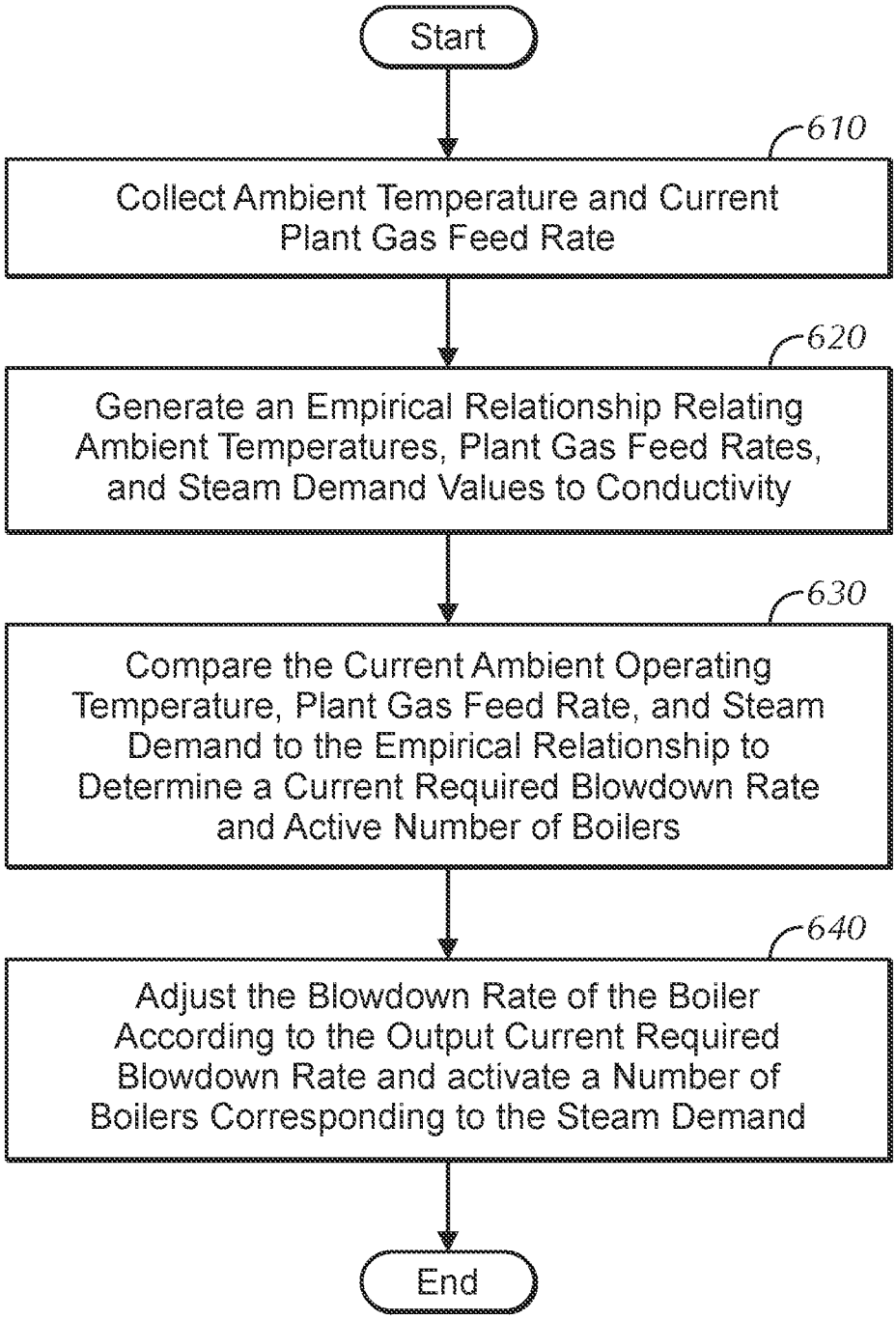
FIG. 6 shows a flowchart of a method in accordance with one or more embodiments of the present disclosure.

FIG. 6 depicts an operational sequence of predicting a blowdown rate of one or more boilers according to one or more embodiments of the invention. While the various flowchart blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 610, the ambient temperature and plant feed gas rates are collected. In particular, the computer 19 collects the ambient temperature and plant gas feed rate from an ambient temperature sensor 13 and a flow rate sensor 15 disposed at each boiler 11. These values are stored in the ambient condition indicator 67 of the dashboard 49.

In block 620, historically collected ambient temperature and plant gas feed rates are correlated in the table of Model A with the historical operating conditions of the plurality of boilers 11 in order to establish an empirical relationship between the historical steam demand, the historical operating conditions, and the historical ambient temperature and current plant gas feed rate of the boilers 11. The operating conditions of the boilers 11 includes the cogen production, the total maximum output of the boilers 11, the current available amount of steam within the plurality of boilers 11, the typical production of a single boiler, a total excess steam level available by the boilers 11, a total cumulative steam production, a date and time at which the data was gathered, and the conductivity corresponding to the total steam demand. The conductivity values are derived from laboratory tests that compare the aperture of the blowdown valve 41 to the to the corresponding steam demand and conductivity. Thus, the output of Model A is a lookup table that correlates the ambient temperature and the current plant gas feed rate to an aperture of the blowdown valve 41, based upon the steam demand and conductivity associated with a specific temperature and feed rate.

In block 630, the current ambient temperature, plant gas feed rate, and steam demand are compared to the table of Model A to determine a blowdown valve adjustment matching the steam demand. In particular, the computer collects the steam demand from a plant intranet or internet via the network 35, and the dashboard 49, or Model B, receives the steam demand from the computer 19. The steam demand is then compared with the dashboard 49 to the empirical data stored in Model A to determine the blowdown rate and number of active boilers 11 associated with the steam demand, where the blowdown rate is determined according to the conductivity change caused by creating the requisite steam demand as described above.

In block 640, the blowdown valve 41 is manually adjusted by an operator according to the determined blowdown rate. Because the output of block 630 is the aperture of the blowdown valve 41, manually adjusting the blowdown valve 41 includes operating the blowdown valve 41 according to the number of turns specified by the dashboard 49. Alternatively, the blowdown valve 41 may be directly connected to the dashboard 49 via the data connection 37, in which case the dashboard 49 is configured to automatically adjust the blowdown valve 41 according to the specified blowdown rate. In addition to adjusting the blowdown valve aperture, the boilers 11 are also activated or deactivated according to the recommendations displayed on the dashboard 49.

Figure 7:
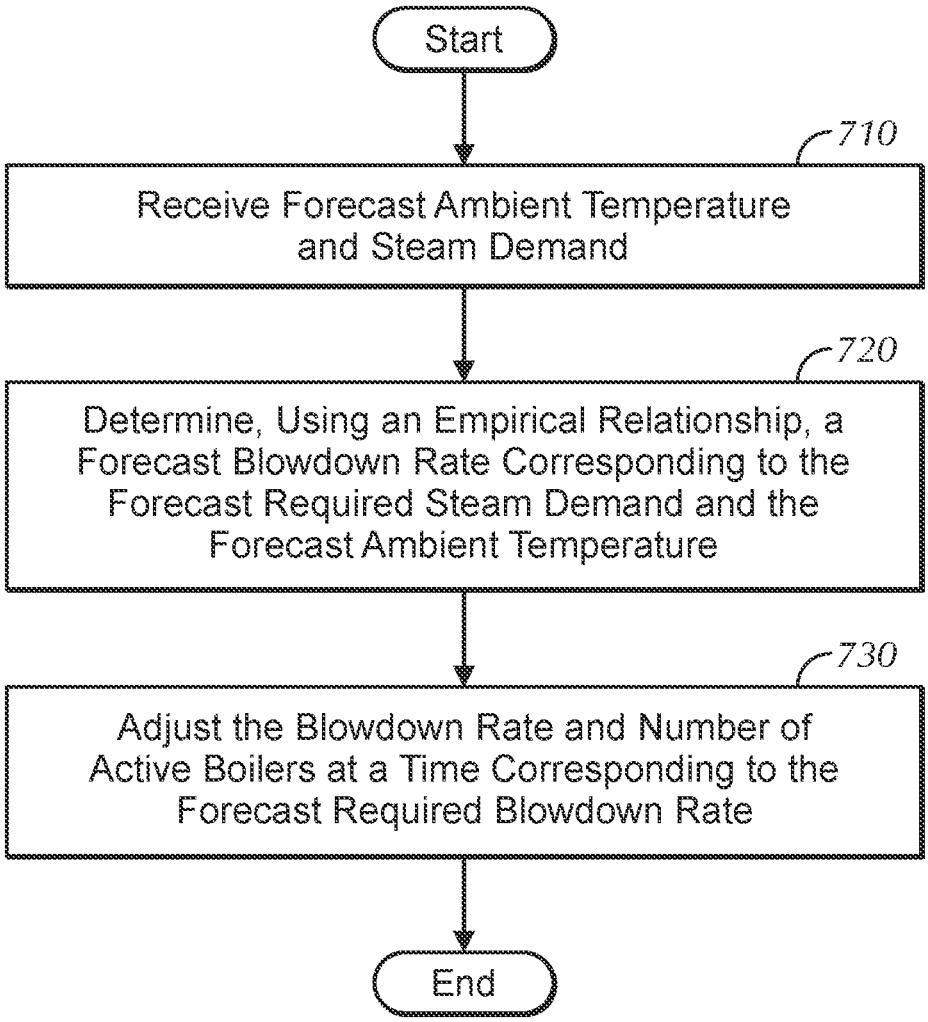
FIG. 7 shows a flowchart of a method in accordance with one or more embodiments of the present disclosure.

FIG. 7 depicts an operational sequence for determining a forecast blowdown valve aperture according to one or more embodiments of the invention. While the various flowchart blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 710, forecast operating conditions, including the forecast ambient temperature and steam demand, are received by the computer 19. Specifically, the computer 19 receives the forecast operating conditions from a plant database for a period of 6 hours via the network 35.

In block 720, Model B determines the forecast blowdown rate based upon the forecast ambient temperature and steam demand. In particular, the forecast ambient temperature and steam demand are compared, with a lookup command, to the empirical data stored in Model A to find a corresponding blowdown rate. The blowdown rate is specified as an empirically determined aperture of the blowdown valve 41, and reflects the amount of blowdown necessary to compensate for a conductivity increase resulting from the steam production.

In block 730, the blowdown valve 41 and the number of active boilers 11 are manually adjusted by an operator according to the determined blowdown rate. As noted above, manually adjusting the blowdown valve 41 includes operating the blowdown valve 41 according to the number of turns specified by the dashboard 49. Similarly, adjusting the number of active boilers 11 includes manually turning a number of boilers 11 on or off according to the recommendation by the dashboard 49.

The blowdown valve 41 may be adjusted at a plurality of times according to the operator's discretion. In a first case, the operator adjusts the blowdown valve 41 immediately upon reception of the forecast blowdown rate. In a second case, the operator waits until the time corresponding to the forecast conditions, at which point the blowdown valve is adjusted accordingly. Finally, in a third case, the blowdown valve is slowly adjusted between the current time and the forecast time such that the blowdown valve 41 aperture matches the forecast blowdown rate at the forecast time. The specific actuation time of the blowdown valve 41 may be determined according to scheduled plant maintenance periods, operator availability, forecast operating conditions, or other relevant factors.

Accordingly, the aforementioned embodiments as disclosed relate to devices and methods useful for predicting blowdown according to a plant's steam demand. As a direct consequence of predicting blowdown with the first and second model, the calculations are performed without human intervention, avoiding the operational cost of completing the calculations in a laboratory. In addition, performing the calculations without human intervention results in a lower financial overhead of the boilers, as the cost of labor is avoided. Furthermore, because the model is repeatedly updated with the current operating conditions of the gas plant, the models accurately reflect the state of the plant boilers even after damage, repeated use, or accumulated scaling. Finally, the aforementioned process avoids any transcription during blowdown rate calculations, and, as such, avoids numerous human errors that may be made during the calculation process.

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method for predicting a blowdown rate of one or more boilers, the method comprising:

generating, with a first model, output data specifying an empirical relationship between a plurality of input temperatures, a plurality of plant gas feed rates, and a plurality of outputs of the one or more boilers;

collecting an ambient operating temperature and a current steam demand of the one or more boilers;

comparing, with a second model, the ambient operating temperature and the current steam demand to the output data to determine a current required blowdown rate;

adjusting the blowdown rate of the one or more boilers according to the current required blowdown rate.

2. The method of claim 1:

wherein the plurality of outputs comprises a series of steam demand values and conductivity values, and wherein the output data comprises a lookup table.

3. The method of claim 1, further comprising determining a total cogeneration amount of the one or more boilers.

4. The method of claim 1, further comprising updating the first model to include current operating conditions of the one or more boilers subsequent to the blowdown rate being adjusted.

5. The method of claim 1, wherein determining the current required blowdown rate comprises determining a conductivity concentration at a required steam demand value and determining the current required blowdown rate necessary relative to the conductivity concentration.

6. The method of claim 1, further comprising receiving and storing forecast operating conditions, the forecast operating conditions including a forecast ambient operating temperature and a forecast steam demand of the one or more boilers.

7. The method of claim 6, further comprising comparing, with the second model, the forecast operating conditions to the first model to determine a forecast required blowdown rate at a time corresponding to the forecast operating conditions.

8. The method of claim 7, further comprising specifying a number of boilers of the one or more boilers that are active at the forecast operating conditions and an aperture of a blowdown valve that achieves the forecast required blowdown rate during blowdown.

9. The method of claim 8, wherein the forecast operating conditions and the forecast required blowdown rate are determined for at least 6 hours after current operating conditions.

10. A system for predicting a blowdown rate of one or more boilers, the system comprising:

a plurality of sensors configured to measure and output an ambient operating temperature and a current steam demand of the one or more boilers;

a first model configured to generate output data specifying an empirical relationship between a plurality of input temperatures, a plurality of plant gas feed rates, and a plurality of outputs of the one or more boilers;

a second model configured to compare the ambient operating temperature and the current steam demand to the output data to determine a current required blowdown rate;

wherein the blowdown rate of the one or more boilers is adjusted according to the current required blowdown rate.

11. The system of claim 10, wherein the plurality of sensors includes:

a thermometer configured to determine the ambient operating temperature of the one or more boilers, and a flow rate sensor configured to determine a current plant gas feed rate.

12. The system of claim 10:

wherein the plurality of outputs comprises a series of steam demand values and conductivity values, and wherein the output data comprises a lookup table.

13. The system of claim 10, wherein the second model is further configured to determine a total cogeneration amount of the one or more boilers.

14. The system of claim 10, wherein the first model is configured to be updated to include current operating conditions of the one or more boilers subsequent to the blowdown rate being adjusted.

15. The system of claim 10, wherein the second model is further configured to determine the current required blowdown rate by determining a conductivity concentration at a required steam demand value and determining the current required blowdown rate necessary relative to the conductivity concentration.

16. The system of claim 10, further comprising a database configured to store and receive forecast operating conditions, the forecast operating conditions including a forecast ambient operating temperature and a forecast steam demand of the one or more boilers.

17. The system of claim 16, wherein the second model is further configured to compare the forecast operating conditions to the first model and determine a forecast required blowdown rate at a time corresponding to the forecast operating conditions.

18. The system of claim 17, wherein the forecast required blowdown rate specifies a number of boilers of the one or more boilers that are active at the forecast operating conditions and an aperture of a blowdown valve that achieves a required blowdown rate during blowdown.

19. The system of claim 18, wherein the forecast operating conditions and the forecast required blowdown rate are determined for at least 6 hours after current operating conditions.

20. The system of claim 18, wherein a minimum number of boilers that are active at the forecast operating conditions is zero.

* * * * *